US007810481B2

(12) United States Patent
Sterner et al.

(10) Patent No.: US 7,810,481 B2
(45) Date of Patent: Oct. 12, 2010

(54) STRING SPLITTER SIGHT FOR A BOW

(76) Inventors: Scot Sterner, 5059 Hickory View Dr., Spring Grove, PA (US) 17362; Stephen Duttera, 983 KBS Rd., Thomasville, PA (US) 17364

( * ) Notice: Subject to any disclaimer, the term of this patent is extended or adjusted under 35 U.S.C. 154(b) by 466 days.

(21) Appl. No.: 11/982,475

(22) Filed: Nov. 2, 2007

(65) Prior Publication Data

US 2009/0114203 A1 May 7, 2009

(51) Int. Cl.
*F41G 1/467* (2006.01)

(52) U.S. Cl. ..... 124/87; 33/265; 124/90

(58) Field of Classification Search ..... 33/265; 124/87, 90

See application file for complete search history.

(56) References Cited

U.S. PATENT DOCUMENTS 3,703,770 A * 11/1972 Sofield ..... 33/265
4,454,857 A 6/1984 Miller et al.
4,656,747 A * 4/1987 Troncoso ..... 33/265
4,860,458 A 8/1989 Ernstsen
4,934,332 A 6/1990 Scherz
5,379,748 A * 1/1995 Carlson ..... 124/87
5,542,186 A * 8/1996 Saunders ..... 33/265
6,024,079 A 2/2000 Ingle et al.
6,282,800 B1 * 9/2001 Beutler ..... 33/265
7,040,027 B1 * 5/2006 Shaffer et al. ..... 33/265
7,266,896 B1 * 9/2007 White ..... 33/265

* cited by examiner

*Primary Examiner*—John Ricci
(74) *Attorney, Agent, or Firm*—Stuart J. Friedman

(57) ABSTRACT

A rear sight for mounting on a multifilament bowstring of an archery bow for sighting a target, including a body having a pair of sides with at least one end extending therebetween, each of the sides having a groove for tightly receiving at least one filament of the multifilament bowstring for mounting the sight within the bowstring, a pair of spaced-apart legs extending from the body end, the legs being either parallel to or diverging from each other and being substantially the same length, the facing surfaces of the spaced-apart legs and the end of the body defining therebetween a generally U-shaped sight window, the sight window being located between the filaments which extend in the side grooves.

16 Claims, 6 Drawing Sheets

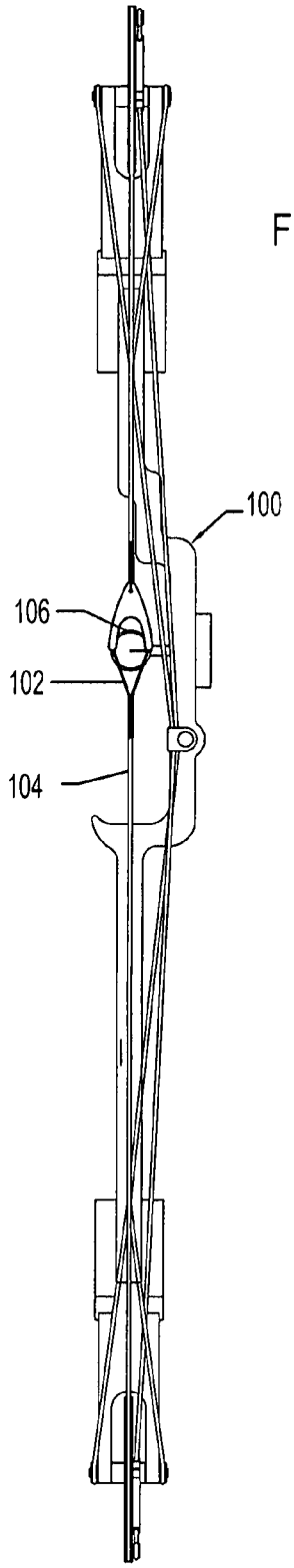
FIGURE 1
FIGURE 2
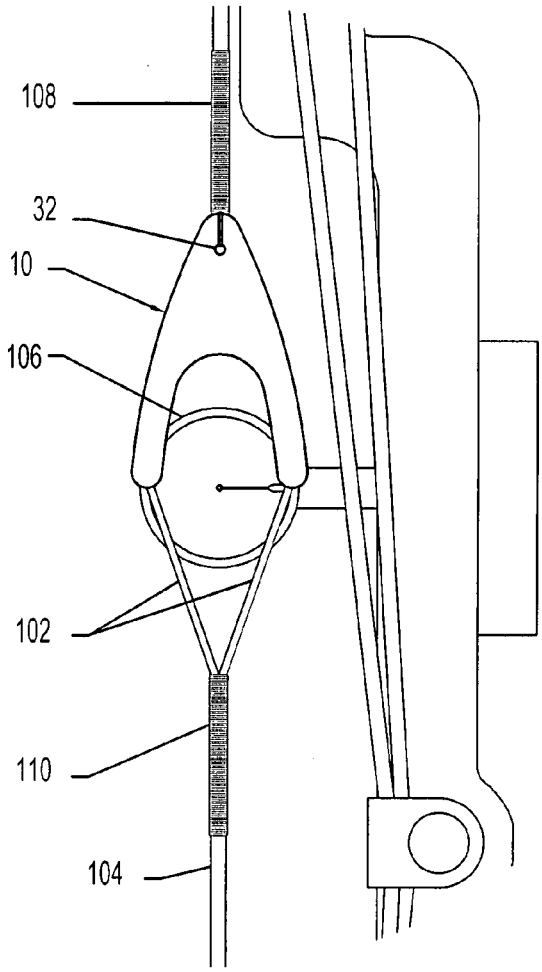

STRING SPLITTER SIGHT FOR A BOW

FIELD OF THE INVENTION

The present invention relates to a string splitter sight for a bow having a vertical bowstring and, more particularly, to a string splitter sight for acquiring a sight window for viewing a front sight mounted to the bow riser.

BACKGROUND OF THE INVENTION

Bowstring mounted peep sights are generally of two types. A first type, illustrated for example in U.S. Pat. No. 4,454,857, U.S. Pat. Nos. 4,860,458 and 4,934,332, comprises an archery bow peep sight in the form of a disk or a wheel having an annular or circumferential opening therein and/or a central aperture. The peep sight is designed to be mounted horizontally such that the axis of the peep is the same as the line of the bowstring. The sight may be mounted either with a multi-stranded bowstring passing through the central aperture or with the strands of a divided multifilament bowstring received in vertical slots in the periphery of the sight body. When the bow is drawn the disk or wheel is tilted revealing to the archer one or more sighting paths through the annular or circumferential openings. Unfortunately, very little of the available light passes through such a peep and the archer's field of view is severely limited.

Another type of peep sight, illustrated for example in U.S. Pat. No. 7,040,027, takes the form of a mounting member having generally vertically disposed side channels serving as guides for receiving the strands of a divided multifilament bowstring. The peep is formed within or supported by the mounting member with its axis generally perpendicular to the riser, i.e., parallel to the axis of an arrow nocked in the bowstring and resting on an arrow rest supported by the riser. In one form of this type of peep sight, a sighting member including a peep aperture of desired shape is slidably and interchangeably received in a channel of the mounting member. However, in this type of peep sight, wherein the peep aperture is surrounded substantially 360° by solid material, a similar problem is encountered as with other peep sights in that insufficient available light is able to pass through the aperture to permit clear and easy sighting. In addition, the field of view through such peep apertures is extremely limited. As a result, game may be missed because of inadequate lighting or simply because the archer cannot see clearly through the peep. In a modification of this type of peep sight, illustrated in U.S. Pat. No. 6,024,079, the mounting member is supported between the filaments of the bowstring and the sighting member is supported by the mounting member, but the peep opening in the sighting member is not positioned between the filaments of the multifilament bowstring. Rather, the sighting member is offset from the mounting body and the bowstring by an angle of about 35° before the bow is drawn and tilts or rotates when the bow is fully drawn to a position wherein the line of sight through the peep is aligned with the front sight and parallel to an arrow correctly mounted in the bow. The peep itself is formed as an opening within the sighting member and may be any shape, such as square or oval, but preferably is semi-circular with a very small gap formed in the wall of the sighting member communicating with the opening to allow additional light to enter the opening. However, the offset arrangement of the sighting member, the inability to sight until the bow is fully drawn and the use of only a very small gap in the peep opening contributes to a peep sight which still transmits insufficient light for good sighting and severely restricts the field of view.

Despite the problems with prior art bowstring mounted peep sights, an archer is seldom better off without a peep sight. Without a peep sight, the archer's vision moves in toward the riser, thereby greatly reducing the field of view. In addition, the archer frequently encounters the halo effect which occurs when trying to look to just one side of the bowstring, with the result that clear vision is impeded.

Accordingly, there is a need for a rear sight which can be mounted as a string splitter sight between the strands of a multifilament bowstring yet which allows almost 100% of available light transmission through the sight and which substantially increases an archer's field of view. In addition, there is a need for a rear sight which allows maximum view of the target during a shot, which can be used with or without a kisser button, which eliminates bulky sight systems and which only nominally reduces arrow speed as compared with a bare bowstring.

SUMMARY OF THE INVENTION

It is, therefore, a primary object of the present invention to provide a split bowstring mounted sight which allows almost all of the available light to be transmitted through the sight for maximum viewing of the target.

It is another object of the present invention to provide a split bowstring mounted sight which significantly increases the field of view as compared with prior art peep sights.

It is still another object of the present invention to provide a split bowstring mounted sight wherein the sight body as well as the sight opening is positioned between the strands of a multifilament bowstring.

It is yet another object of the present invention to provide a split bowstring mounted sight which only nominally reduces arrow speed.

It is still another object of the present invention to provide a split bowstring mounted sight which does not require aligning posts or tethers to align or maintain alignment of the sight within the bowstring.

The foregoing and other objects are achieved in accordance with the present invention by providing a rear sight for mounting on a multifilament bowstring of an archery bow for sighting a target, comprising:

a body having a pair of sides with at least one end extending therebetween, each of said sides having a groove for tightly receiving at least one filament of said multifilament bowstring for mounting said sight within said bowstring;

a pair of spaced-apart legs extending from said end, said legs being either parallel to or diverging from each other, the facing surfaces of said spaced-apart legs and said end of said body defining therebetween a generally U-shaped sight window, said sight window being located between the filaments which extend in said side grooves.

In another aspect of the present invention, the legs are of substantially the same length, the outside surfaces of the legs are adjacent to the sides of the body and the outside surfaces of the legs comprise a continuation of the contour of the body sides.

In still another aspect of the present invention the outside surfaces of each of the legs are provided with a groove for tightly receiving the filaments which extend along the side grooves.

In yet another aspect of the present invention the body and the legs are unitary.

In still another aspect of the present invention the body is generally triangular having an upper apex, the pair of sides curve outwardly and downwardly in a slight arc, the legs are of substantially equal length, extend downwardly from the body with the outside surface of each leg adjacent to one of the body sides and comprise a continuation of the gentle arc of the body sides, and the outside surfaces of the legs are provided with a continuation of the grooves in the body sides for tightly receiving the bowstring filaments which extend in the side grooves.

In one more aspect of the present invention the end of the body is upwardly arcuate and the U-shaped sight window defined between the end and the inside surfaces of the legs is generally half-elliptical.

In yet another aspect of the present invention the sight window further includes the generally triangular window defined by the split bowstring between the lower tips of the legs and the point along the bowstring where the split bowstring reunites.

In another aspect of the present invention the sight window defined by the generally half-elliptical window portion and the generally triangular-window portion is symmetrical on both sides of the vertical axis of the sight window but not symmetrical on both sides of the horizontal axis of the sight window.

BRIEF DESCRIPTION OF THE DRAWINGS

FIG. 1 is a rear elevational view of a conventional compound bow having the sight of the present invention mounted between the strands of a multifilament bowstring, as it appears to the archer before the bow string is drawn.

FIG. 2 is an enlarged rear elevational view of a portion of FIG. 1.

DESCRIPTION OF THE PREFERRED EMBODIMENT

Figure 8:
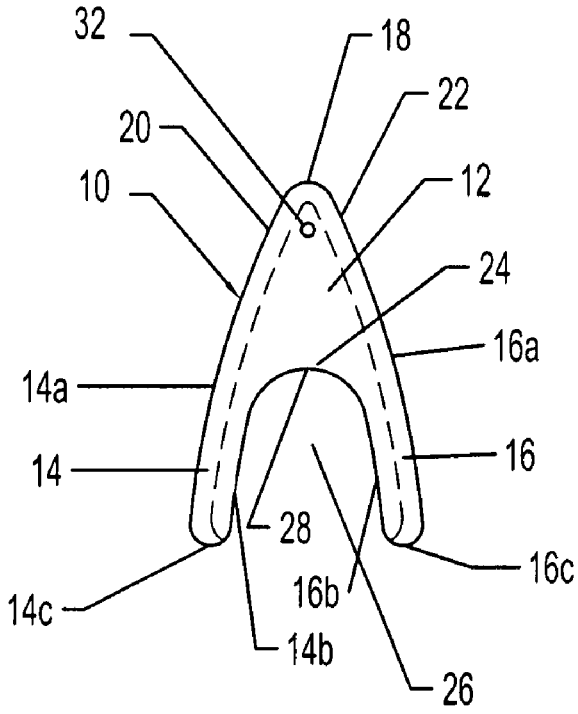
FIG. 8 is a top plan view of a preferred embodiment of the sight of the present invention.
Figure 9:
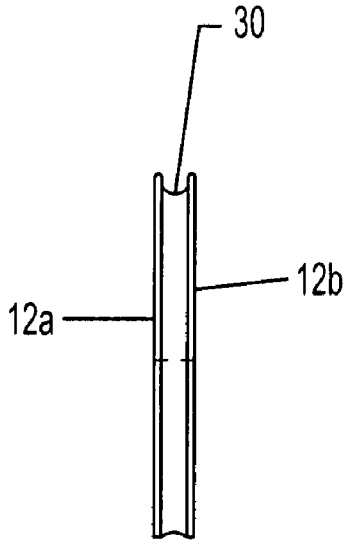
FIG. 9 is a side elevational view of the sight of FIG. 8.
Figure 10:
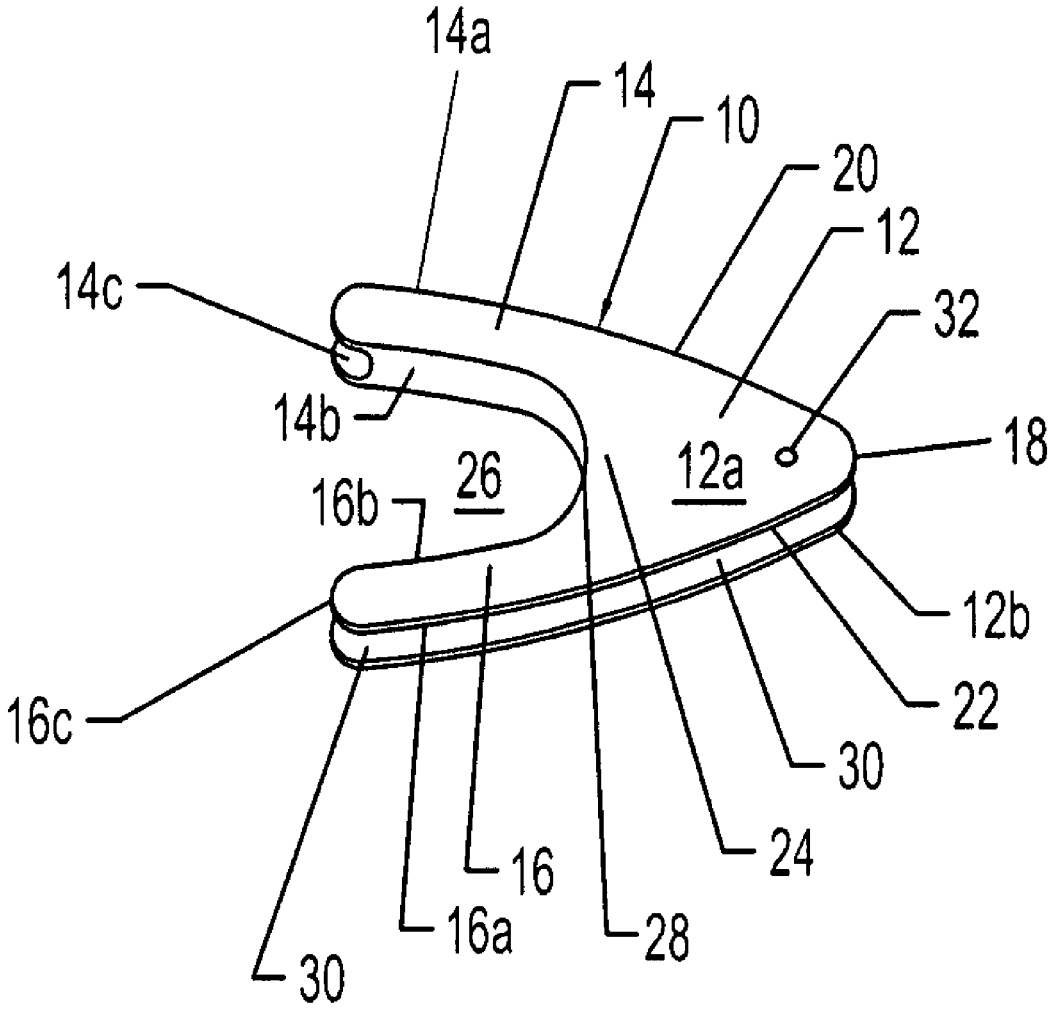
FIG. 10 is a perspective view of the sight of FIG. 8.

FIGS. 1-10, particularly FIGS. 8-10, show the rear string splitter sight 10 of the present invention. The sight 10 includes a body 12 and a pair of spaced-apart sighting legs 14, 16 extending from one side of body 12 in generally the same direction for defining a sighting window in the opening between the legs 14, 16 and the side of the body 12 from which the legs extend. Body 12 can have any desired shape, such as a quadrilateral, triangle, ellipse, circle, or the like, subject only to the considerations described hereinafter with respect to mounting the body 12 between filaments of a multifilament bowstring. Legs 14, 16 may extend from the body 12 either parallel to or diverging from each other and may be either straight or arcuate. The legs 14, 16 define with the lower portion 24 of body 12 a generally downwardly opening U-shaped configuration having a downwardly facing trough 28. The lower portion 24 of body 12, while desirably arcuate to define an arcuate trough, may also be flat or may include portions projecting into the downwardly opening U-shape. Body 12 and legs 14, 16 have grooves 30 along their outwardly facing sides to allow for mounting sight 10 between the filaments of a multifilament bowstring.

In the preferred embodiment of the invention, body 12 is generally triangular having an apex 18 with the sides 20, 22 curved outwardly and downwardly in a slight arc such that the body is essentially partially navicular in shape. Each of legs 14, 16 extend downwardly from body 12 with the outside surface 14*a*, 16*a* of each leg 14, 16 adjacent to sides 20, 22 and, preferably, slightly arcuate, in order to comprise a continuation of the arc of sides 20, 22, respectively. Desirably, body 12 and legs 14, 16 are unitary and legs 14, 16 are of the same length. The inside peripheral surfaces 14*b*, 16*b* of legs 14, 16 define with the lower portion 24 of body 12 a generally downwardly opening U-shaped portion 26 of sight window 112 (see FIG. 6) having a trough 28. When viewed together, in the preferred embodiment, body 12 and legs 14, 16 somewhat resemble the letter "A" except that the sides 20, 22 and the legs 14, 16 extending therefrom are curved outwardly in a slight arc. Sight 10 is preferably formed of a lightweight, strong material such as aluminum or carbon, but may be formed from any desired shapeable material having sufficient strength to withstand the stresses of archery, including but not limited to metals, plastics, wood, ceramics, and the like.

Each of the sides 20, 22 of body 12 is provided with a groove 30, having a depth more than half the diameter of bowstring 104, which accommodates at least one filament 102, preferably half of the filaments, of a multifilament bowstring 104 of archery bow 100. The grooves divide body 12 into a front surface 12*a* and a rear surface 12*b*, both of which are desirably flat. The outside surfaces 14*a*, 16*a* of each leg 14, 16, comprising a continuation of the arc of body sides 20, 22, are also provided with groove 30 running therealong. The grooves 30 in sides 20, 22 and leg surfaces 14*a*, 16*a* serve to tightly receive filaments 102 of bowstring 104 so as to thereby mount the sight 10 of the present invention within the bowstring 104 of bow 100. This configuration is particularly desirable because the continuous grooves in the body 12 and legs 14, 16 generally follow the natural contour of the bowstring and, therefore, the bowstring contacts and tightly holds substantially the entire perimeter of sight 10, thus securely retaining it in place in the bowstring.

For purposes of illustration only, in a preferred embodiment, the body of sight 10 has a length from apex 18 to the bottom of lower portion 24 of 0.866 inches, legs 14, 16 have a length from body lower portion 24 to their lower ends 14*c*, 16*c* of 0.821 inches, the inside surfaces 14*b*, 16*b* at their lower ends 14*c*, 16*c* are separated by 0.647 inches, body 12 has a thickness between front surface 12*a* and rear surface 12*b* of 0.188 inches and grooves 30 have maximum depth of 0.093 inches. It will be appreciated, however, that the dimensions of sight 10 can be smaller or larger depending upon the preference of the archer, the light conditions and the game being hunted.

Sight 10 of the present invention is inserted within bowstring 104 in a well known and conventional manner whereby a string separator is slid through the filaments of bowstring 104 at a point above where an arrow 114 is nocked, preferably dividing the filaments evenly, and sight 10 is inserted into bowstring 104 in such a manner that the evenly divided filaments 102 run into the groove 30 on sides 20, 22 and leg sides 14*a*, 16*a* for mounting the sight 10 vertically in the undrawn bowstring 104. The position of sight 10 is adjusted by drawing bow 100, placing the archer's head in its normal shooting position, such as with the tip of the archer's nose on the bowstring 104, moving the sight 10 up or down the bowstring 104 until the front sight 106 and a selected target is visible through the generally half-elliptical portion 26 of sight window 112 defined by the inside surfaces 14*b*, 16*b* of legs 14, 16 and trough 28. The sight 10 is then fixed in position on the bowstring 104 by wrapping serving thread around bowstring 104 above and below sight 10 to form top serving 108 and bottom serving 110, tying the thread in an appropriate knot to prevent the wrapped servings 108, 110 from loosening and affixing the serving thread to sight 10, as by affixing it to aperture 32 which passes through body 12 at a position near its apex 18. Top serving 108 creates a downward force and bottom serving 110 creates an upward force while bowstring 104 is in tension for retaining sight 10 in fixed position in the bowstring 104 at all times during a shot.

Figure 4:
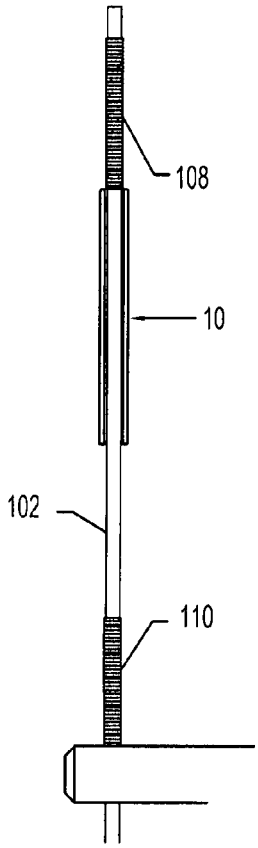
FIG. 4 is an enlarged side elevational view of a portion of FIG. 3.
Figure 3:
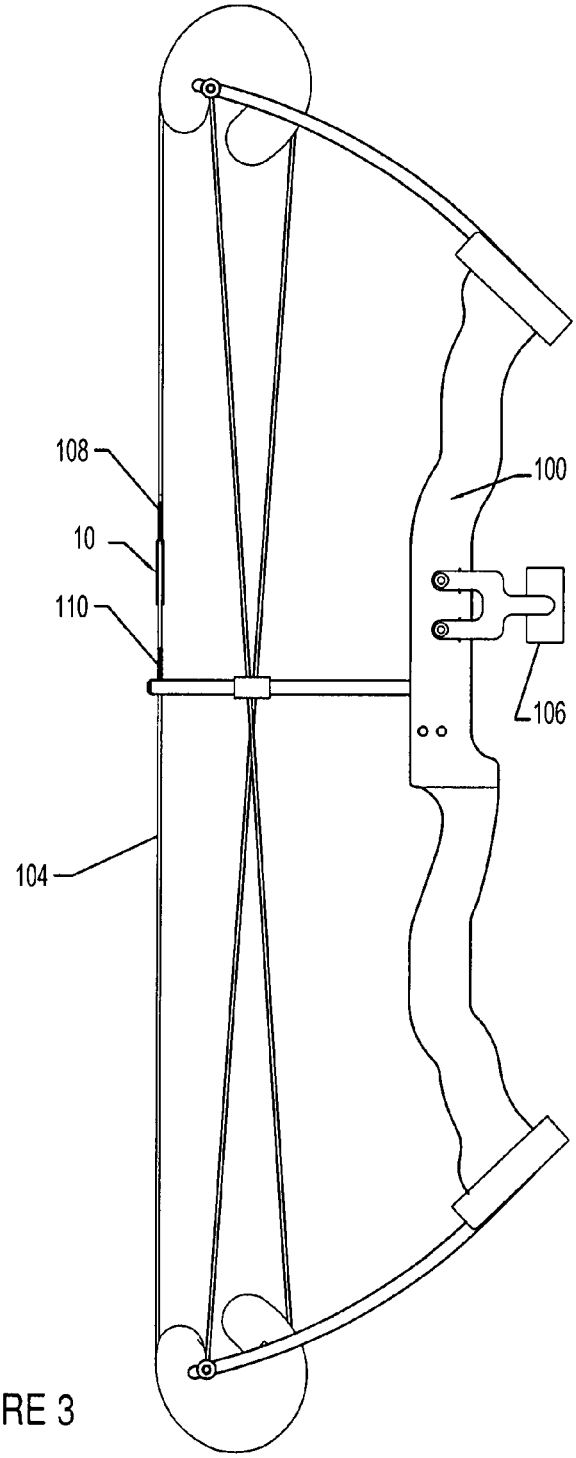
FIG. 3 is a side elevational view of the bow and sight of FIG. 1.
Figure 5:
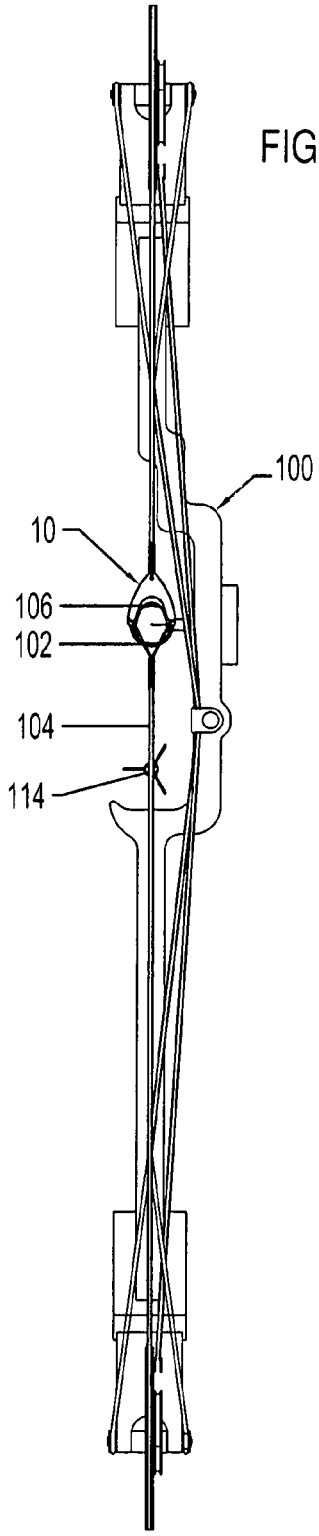
FIG. 5 is a rear elevational view of the bow of FIG. 1 at full draw.
Figure 6:
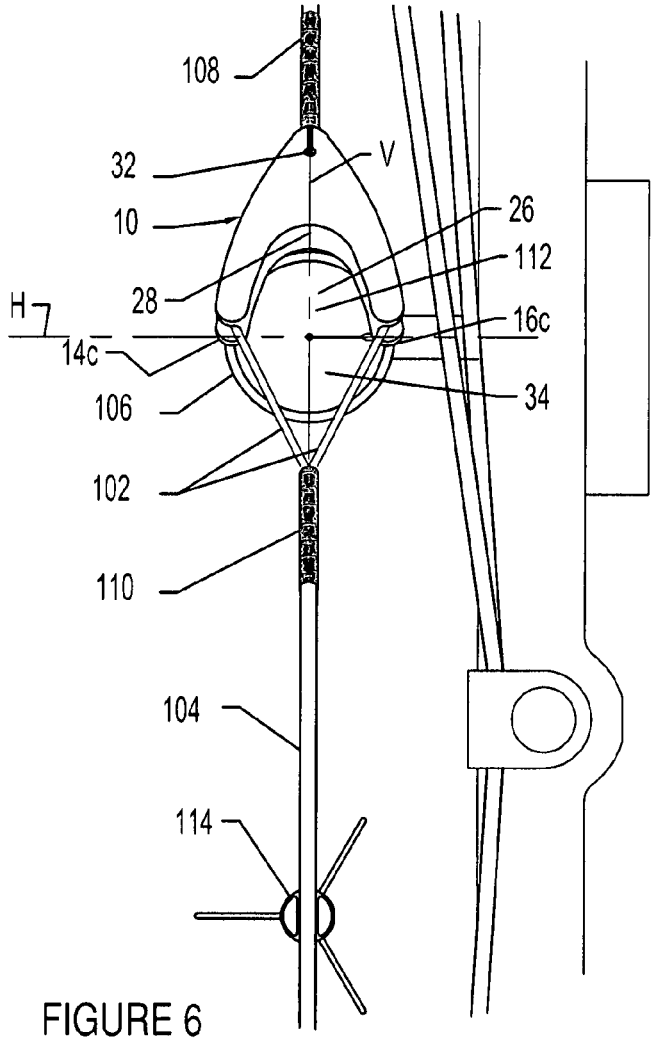
FIG. 6 is an enlarged rear elevational view of a portion of FIG. 5.
Figure 7:
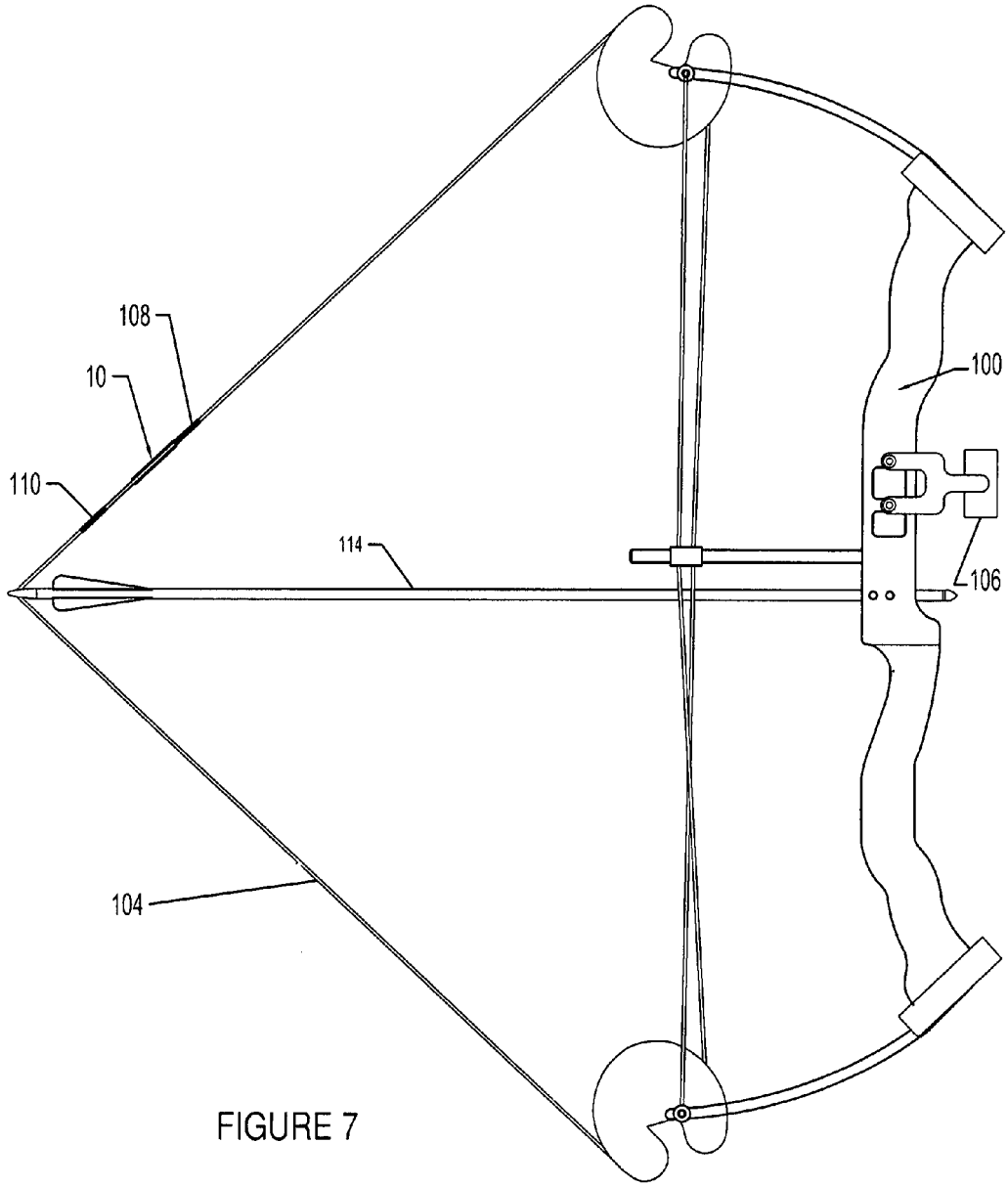
FIG. 7 is a side elevational view of the bow of FIG. 1 at full draw.

As can be seen most clearly in FIG. 6, in which the bowstring 104 is fully drawn, sight 10 of the present invention together with the split bowstring filaments 102 and lower serving 110 create a sight window 112 for the archer which is vertically symmetrical but horizontally non-symmetrical. The archer's sight window 112 includes the generally half-elliptical portion 26 defined by the inside surfaces 14*b*, 16*b* of legs 14, 16 and trough 28 and the generally triangular portion 34 defined by the split bowstring 102 between the lower tips 14*c*, 16*c* of legs 14, 16 and the top of bottom serving 110. The vertical axis V of this sight window 112 corresponds to the line of the bowstring extended through top serving 108, sight 10, the split bowstring and bottom serving 110. The horizontal axis H of this sight window 112 extends horizontally along the lower tips 14*c*, 16*c* of legs 14, 16. It will be appreciated that the sight window 112 is symmetrical on both sides of the vertical axis V but that the generally half-elliptical upper portion 26 of the sight window 112 is not symmetrical with the generally triangular lower portion 34 of the sight window 112. To sight on a target using a circular front mounted sight 106, an archer need only align the circular front sight 106 with the target and align the sight 10 of the present invention with the circular front sight 106 by aligning the center of trough 28 with 12 o'clock on the circular front sight 106 while, at the same time, aligning the lower tips 14*c*, 16*c* of legs 14, 16 with 9 o'clock and 3 o'clock, respectively, on the circular front sight 106. The generally triangular lower portion 34 of sight window 112 together with the generally half-elliptical upper portion 26 of sight window 112 allows almost 100% of the available light to pass through the sight window 112 of sight 10.

While the present invention has been described in terms of specific embodiments thereof, it will be understood that no limitations are intended to the details of construction or design other than as defined in the appended claims.

The invention claimed is:

1. A rear sight for mounting on a multifilament bowstring of an archery bow for sighting a target, comprising:

a body having a pair of sides with at least one end extending therebetween, each of said sides having a groove extending therealong for tightly receiving at least one filament of said multifilament bowstring for mounting said sight within said bowstring;

a pair of spaced-apart legs extending from said end, said legs being either parallel to or diverging from each other, the facing surfaces of said spaced-apart legs and said end of said body defining therebetween a generally U-shaped sight window, said outside surfaces of each of said legs being provided with a groove extending therealong for tightly receiving the filaments which extend along said side grooves, said sight window being located between the filaments which extend in said side and leg grooves.

2. A rear sight, as claimed in claim 1, wherein said legs are of substantially the same length.

3. A rear sight, as claimed in claim 2, wherein the outside surfaces of said legs are adjacent to the sides of said body.

4. A rear sight, as claimed in claim 3, wherein the outside surfaces of said legs comprise a continuation of the contour of said body sides.

5. A rear sight, as claimed in claim 1, wherein said body and said legs are unitary.

6. A rear sight, as claimed in claim 1, wherein said body is generally triangular having an upper apex, said pair of sides curving outwardly and downwardly in a slight arc.

7. A rear sight, as claimed in claim 6, wherein said legs are of substantially equal length, extend downwardly from said body with the outside surface of each leg adjacent to one of said body sides and comprising a continuation of the gentle arc of said body sides, the outside surfaces of said legs being provided with a continuation of the grooves in said body sides for tightly receiving the bowstring filaments which extend in said side grooves.

8. A rear sight, as claimed in claim 7, wherein said body and said legs, taken together, are generally A-shaped.

9. A rear sight, as claimed in claim 6, wherein said end of said body is upwardly arcuate and said U-shaped sight window defined between said end and the inside surfaces of said legs is generally half-elliptical.

10. A rear sight, as claimed in claim 9, wherein said sight window further includes the generally triangular window defined by the split bowstring between the lower tips of the legs and the point along the bowstring where the split bowstring reunites.

11. A rear sight, as claimed in claim 10, further including top and bottom servings on the bowstring above and below said rear sight where the bowstring filaments split and reunite, respectively.

12. A rear sight, as claimed in claim 10, wherein the sight window defined by the generally half-elliptical window portion and the generally triangular window portion is symmetrical on both sides of the vertical axis of the sight window, said vertical axis corresponding to the line of the bowstring.

13. A rear sight, as claimed in claim 10, wherein the sight window defined by the generally half-elliptical window portion and the generally triangular window portion is not symmetrical on both sides of the horizontal axis of the sight window, said horizontal axis extending along the lower tips of said legs.

14. A rear sight, as claimed in claim 6, wherein said body is partially navicular in shape.

15. A rear sight, as claimed in claim 1, wherein said body and legs are unitary and formed from a material selected from aluminum and carbon.

16. A rear sight, as claimed in claim 1, wherein said sight is mounted vertically between the filaments of the undrawn bowstring when said undrawn bowstring is oriented vertically.

* * * * *